United States Patent [19]

Shiomi et al.

[11] Patent Number: 4,674,424

[45] Date of Patent: Jun. 23, 1987

[54] PRESSER FOOT LIFTING MECHANISM

[75] Inventors: Kengo Shiomi; Toshimasa Asai; Toshiyuka Kato, all of Chofu, Japan

[73] Assignee: Tokyo Juki Industrial Co., Ltd., Tokyo, Japan

[21] Appl. No.: 833,912

[22] Filed: Feb. 26, 1986

[30] Foreign Application Priority Data

Feb. 26, 1985 [JP] Japan ..... 60-37057

[51] Int. Cl.[4] ..... D05B 29/02

[52] U.S. Cl. ..... 112/237

[58] Field of Search ..... 112/237, 238, 239

[56] References Cited

U.S. PATENT DOCUMENTS 3,347,194 10/1967 Hale et al. ..... 112/237
4,388,886 6/1983 Adams ..... 112/237
4,409,914 10/1983 Sansone ..... 112/237

FOREIGN PATENT DOCUMENTS

PCT/JP84/0-
0140 3/1984 PCT Int'l Appl. .

*Primary Examiner*—Werner H. Schroeder
*Assistant Examiner*—Andrew M. Falik
*Attorney, Agent, or Firm*—Morgan & Finnegan

[57] ABSTRACT

In a sewing machine, a presser foot lifting mechanism provides two springs, a first spring the compression of which can be changed by a solenoid actuated coil linkage and a second spring the compression of which can be changed by an operator's knee-action for lowering a presser foot. An operation lever rotated by an operator's knee-action controls the timing of solenoid action. A positional difference or gap is provided for the operation lever between a "solenoid on" position and a "first spring off" position, so that an operator can rotate the operation lever without feeling the resisting force of the first spring.

4 Claims, 6 Drawing Figures

PRESSER FOOT LIFTING MECHANISM

BACKGROUND OF THE INVENTION

The invention relates to sewing machines and more particularly to a presser foot lifting mechanism for a sewing machine.

One conventional way of lifting a presser foot in an industrial lock-stitch type sewing machine is illustrated in FIG. 6 with its sectional view. Referring to FIG. 6, a presser foot 53 is urged to press a throat plate 52 by a presser spring 51. A solenoid 54 is excited by a knee-operated switch 56 which is recessed in a knee abutment member 55. The presser foot is lifted by the solenoid action via a lever 57, a presser rod 59 which is located in a oil pan 58, a bar 60, a lever 61, a connecting rod 62, a lever 63 and finally by a stop rod 65. Thus the presser foot is lifted from the throat plate.

In such conventional means, presser foot lifting fatigue experienced by an operator may be lessened by the force of the solenoid 54. However, the position of the presser foot is defined only by two points, the lowest point touching with the throat plate and the highest point responding to the maximum stroke of the solenoid. Thereby, when the workpiece is thick or when the presser foot is to be positioned at an intermediate point to place the workpiece or to ease the operation, the mechanism was inconvenient and led to operator fatique. The embodiment of the foregoing "presser foot lifting mechanism" invention is disclosed in PCT application No. JP-84/00140.

It is therefore an object of the invention to provide a presser foot lifting mechanism for a sewing machine which is effective to lessen operator fatigue.

SUMMARY OF THE INVENTION

These and other objects of the invention are met by providing a presser foot lifting mechanism, including a presser bar having a presser foot at lower end and sustained to move up and down relative to the sewing machine frame, a pair of springs disposed separately along the presser bar and urged to press the presser bar downwardly, an operation lever moved by knee-action from a predetermined position in one direction, and a linkage assembly for lifting the presser bar against the spring in relation to the displacement of the operation lever from a predetermined position. A signal detecting means detects signals generated in relation to the displacement of the operation lever and a magnetic drive means releases one of the springs. A control circuit energizes the magnetic drive means in relation to the generated signals. The distance between a "signal detected" point and a "first spring off" point for the operation lever are arranged to take more time than the time interval from detecting a "solenoid on" signal to the time when the solenoid actually has worked. The invention thereby allows the operator to rotate the operation lever without feeling the resisting force of the first spring.

BRIEF DESCRIPTION OF THE DRAWINGS

The invention will be described in greater detail below by way of reference to the following drawings, in which.

DETAILED DESCRIPTION OF THE DRAWINGS

Figure 1:
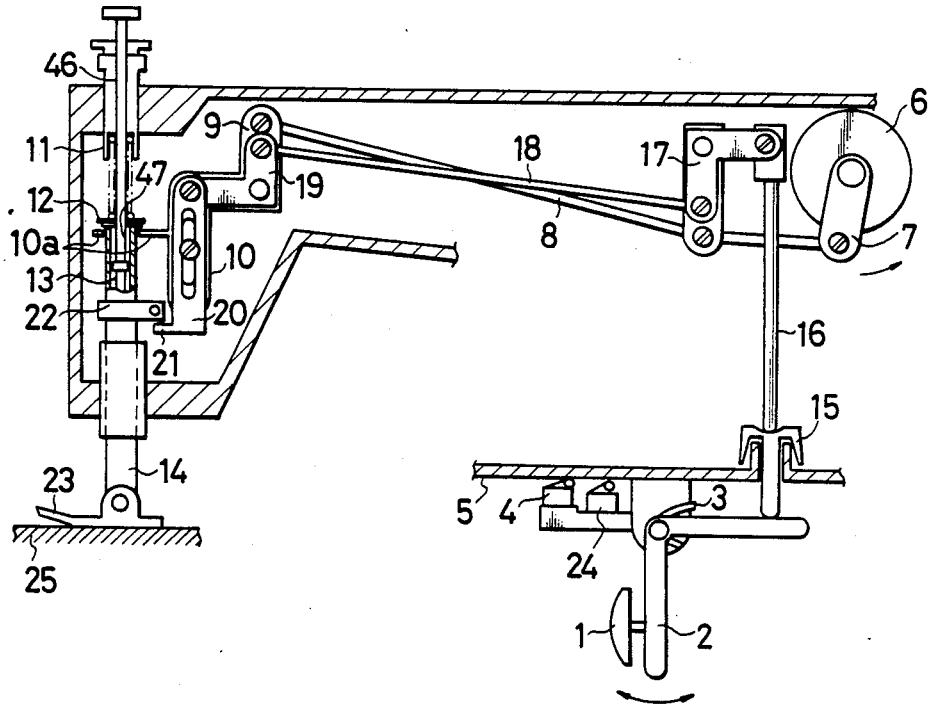
FIG. 1 illustrates a front view of presser bar lifting mechanism according to one embodiment of the present invention.

Referring to FIG. 1, one embodiment of the present invention will be explained.

In the embodiment of FIG. 1, a presser foot 23 is pivoted at the lower portion of a presser bar 14. The presser bar 14 is sustained to move up and down slidably through the machine frame. A presser bar spring 11 and an auxiliarly spring 13 are provided at the upper end of the presser bar 14. By these spring means 11, 13 the presser foot 23 is urged to press the throat plate with appropriate force.

A workpiece (not shown) may be clamped between the presser foot 23 and the throat plate 25.

The presser bar spring 11 surrounds a guide bar 46, and the auxiliary spring 13 is placed in a bore-hole 47 which is provided at the upper end of the presser bar 14. The upper portion of the guide bar 46 is sustained slidably by an adjusting member screwed into the machine frame, and the lower end of the guide bar 46 presses the auxiliary spring 13 inserted in the bore hole 47. The presser bar spring 11 is placed slidably between the ring plate 12, whose center portion is pierced by the guide bar 46, and the lower end of the adjusting members.

Forces of the pressure bar spring 11 and the auxiliary spring 13 are appropriately designed, and generally, the former is stronger than the latter.

A drive means, which may be magnetic, such as rotary solenoid 6 with its solenoid arm 7, is fixed to the frame. A first link-assembly comprises a spring lift arm 10 having a stopper **10*a* which engages with the ring plate 12 whose center portion is pierced by the guide bar 46, a bell crank 9 connected to the spring lift arm 10, and a connecting rod 8 which connects the bell crank 9 with a solenoid arm 7. The spring lift arm 10 provides a slot hole, and a fastening means such as a screw may be screwed passing through this slot hole to the frame. Accordingly, the spring lift arm 10** slides up and down along the slot hole.

The center of the bell crank 9 is sustained rotatably by the frame. One end of the bell crank 9 is pivoted to the upper portion of the spring lift arm 10 and another end is pivoted to the end of the connecting rod 8.

A lifting mechanism in this embodiment includes a presser bar lift arm 20 which moves up and down along the slot hole provided therein engaging with a transverse rod 22 projected from the presser bar, a first bell crank 19 connected to the presser bar lift arm 20, a second crank bell 17, a presser rod 15 which slides through an oil pan frame 5, a first connecting rod 18 which connects the first bell-crank 19 with the second bell crank 17, and a second connecting rod 16 which is positioned between the second bell crank 17 and the presser rod 15. The presser bar lift arm 20 provides a horizontal arm 21 and may be retained by a screw passing through a slot hole therein in a similar manner as the spring lift arm 10.

In this embodiment, a single screw passes through the two overlapped slot holes of the presser bar lift arm 20 and the spring lift arm 10, and is screwed into the machine frame. The horizontal arm 21 of the presser bar lift arm 20 is disposed adjacently under the transverse rod 22.

The center portion of the first bell crank 19 may be supported rotatably by a screw which, in this embodiment, likewise supported the bell crank 9. One end of the first bell crank 19 is pivoted at the upper portion of the presser bar lift arm 20, and another end is pivoted at the end of the connecting rod 18.

The second bell crank 17 may be rotatably attached at the central portion thereof to the machine frame by a screw. One end of the second bell crank 17 is connected to one end of the connecting rod 18, and another end of the bell crank 17 is connected to one end of the second connecting rod 16. The other end of the second connecting rod 16 is in contact with the presser rod 15 and this presser rod 15 provides a circumferencial projection extending downwardly.

An operation lever 2 in this embodiment is L-shaped and is rotatably attached at the central portion thereof to the lower frame of the oil pan 5. The operation lever 2 is normally urged to rotate clockwise by a spring 3. One end of the operation lever provides a knee abutment 1, and another end of the operation lever contacts the lower end of the presser rod 15.

Switches 4, 24 are provided each as a type of "limit switch" and control the on-off status of the solenoid 6. The moveable contacts of the limit switches 4, 24 normally contact the bottom of the oil pan frame 5, placing the solenoid 6 in an off condition. When the operation lever 2 is rotated counter-clockwise against the force of the spring 3, the limit switches 4, 24 separate from the bottom of the oil pan frame 5 and excite the solenoid 6. These limit switches can, of course, be substituted by access switches or photo sensor switches.

Figure 3:
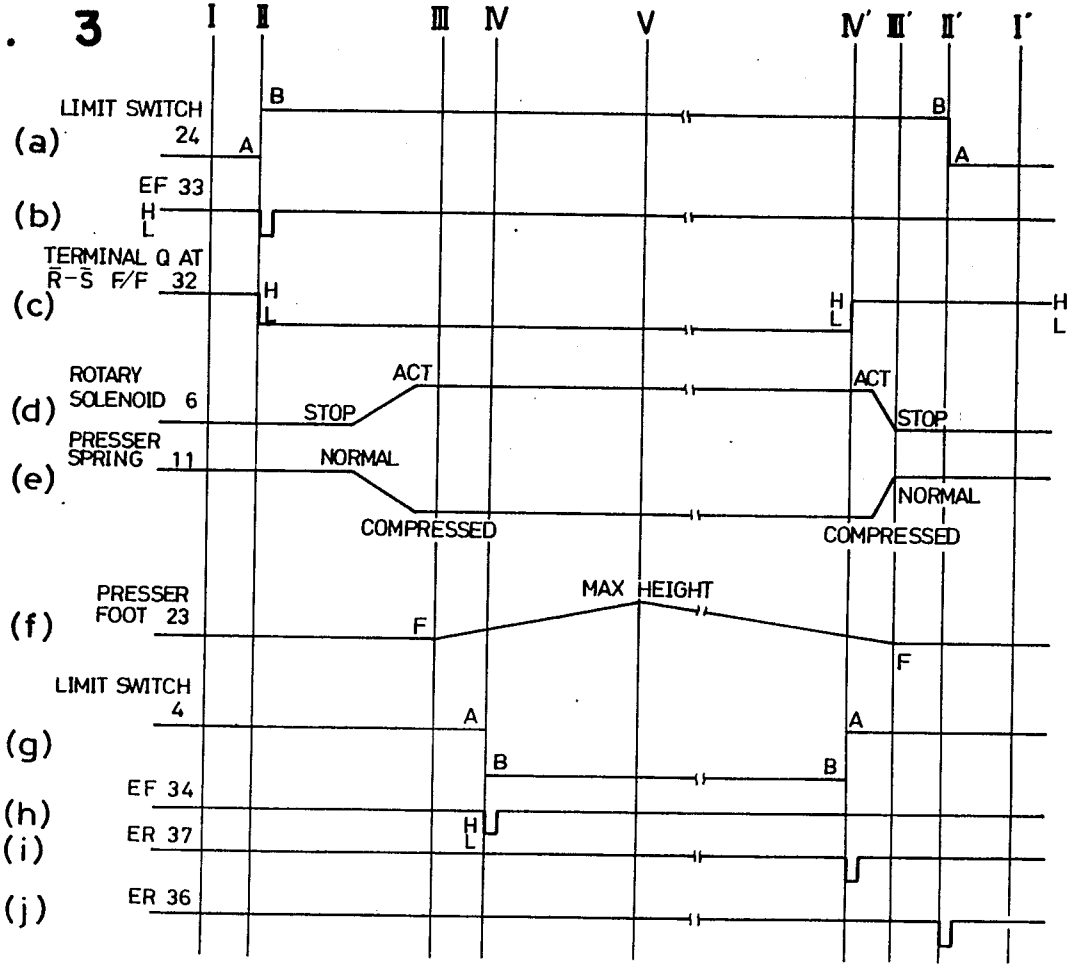
FIG. 3 is a time chart illustrating the timing of operation in an embodiment according to the present invention.
Figure 4:
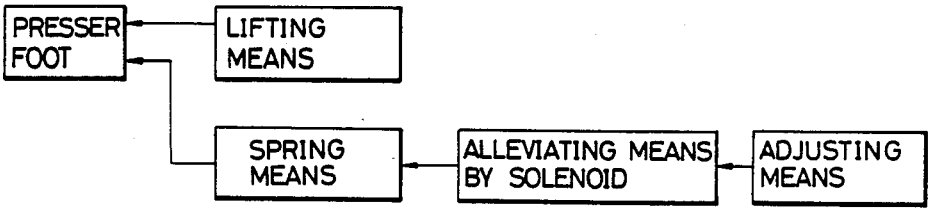
FIG. 4 is a block diagram illustrating a configuration according to the present invention.

Referring to the timing diagram of FIG. 3, limit switches 4, 24 excite in the order of 24-4 when the operation lever 2 rotates counter clockwise and "unexcite" or switch off in the order of 4-24 when the operation lever 2 rotates clockwise.

Figure 2:
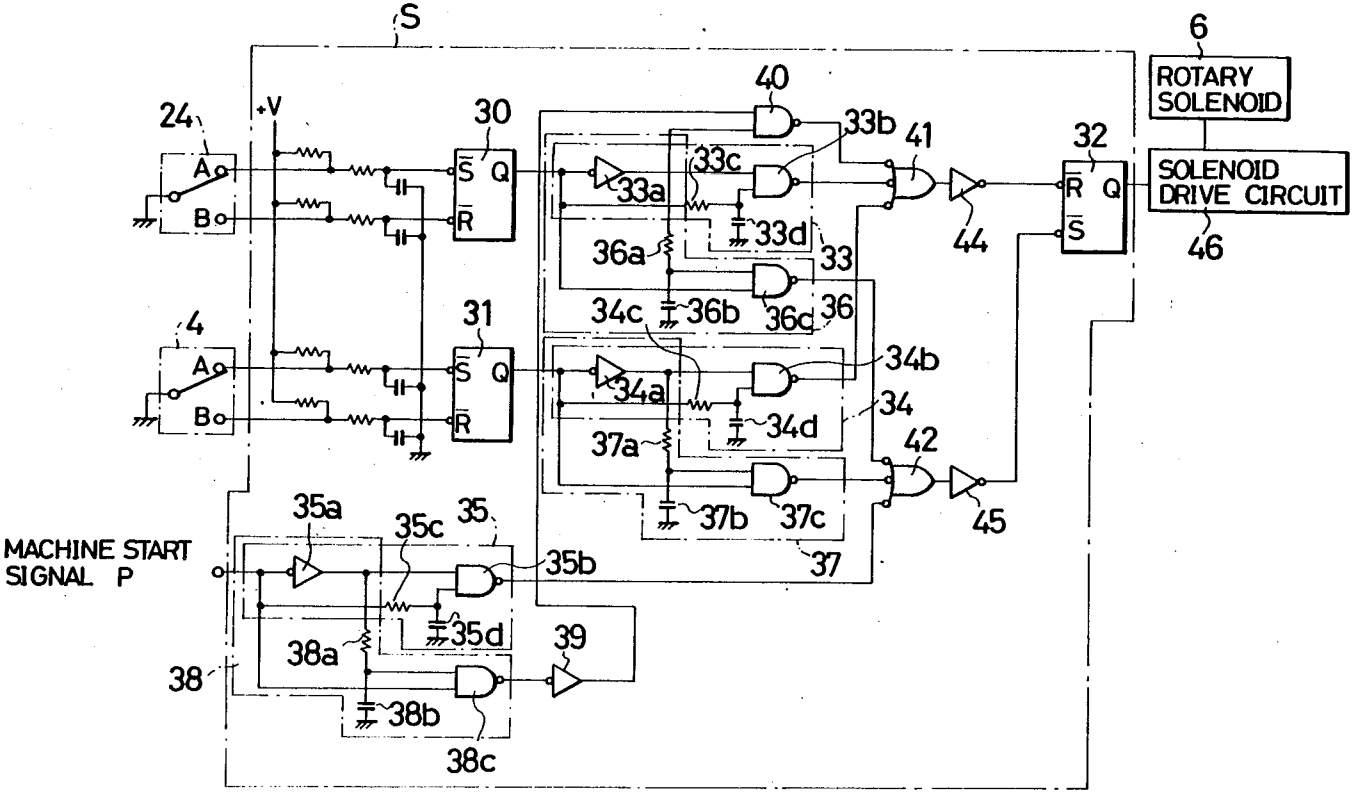
FIG. 2 is a electrical circuit diagram according to the present invention.

Referring to the circuit diagram of FIG. 2, S denotes an adjusting circuit which may be comprised as follows. In FIG. 2, numerals 30, 31, 32 denote $\overline{R}$-$\overline{S}$ FLIP-FLOPs ($\overline{R}$-$\overline{S}$ F/F). Numerals 33, 34, 35 denote wave form trailing edge or down-edge-detecting circuits (EF) for example (b) and (c) in FIG. 3. EF 33 comprises an inverter 33*a*, a NAND-gate 33*b*, a resistance 33*c*, and a condenser 33*d*. EF 34 comprises an inverter 34*a*, a NAND-gate 34*b*, a resistance 34*c*, and a condenser 34*d*. EF 35 comprises an inverter 35*a*, a NAND-gate 35*b*, a resistance 35*c*, and a condenser 35*d*.

Numerals 36, 37, 38 denote wave form leading edge detecting circuits (ER) ER 36 comprises an inverter 33*a*for example; and (j) in FIG. 3., a resistance 36*a*, a condenser 36*b*, and a NAND-gate 36*c*. ER 37 comprises an inverter 34*a*, a resistance 37*a*, a condenser 37*b*, and a NAND-gate 37*c*. ER 38 comprises an inverter 35*a*, a resistance 38*a*, a condenser 38*b*, and a NAND-gate 38*c*.

Adjusting circuit S further includes an inverter 39, NAND-gates 40, 41, 42 and inverters 44, 45. Numeral 46 denotes solenoid-drive-circuit for the rotary solenoid 6.

As discussed above with regards to FIG. 1, the presser foot lifting means includes a knee-abutment 1, an operation lever 2, a ring plate 12, a presser bar 14, a presser rod 15, a second connecting rod 16, a first bell crank 17, a connecting rod 18, a second bell crank 19, a presser bar lift arm 20, a horizontal arm 21, and a transverse rod 22. The presser foot pressing means includes a presser bar spring 11, and the auxiliary spring 13.

Figure 5:
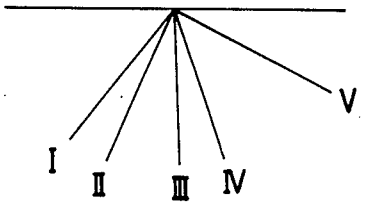
FIG. 5 is an explanatory drawing for positioning of an operator's lever in an embodiment according to the present invention.
Figure 6:
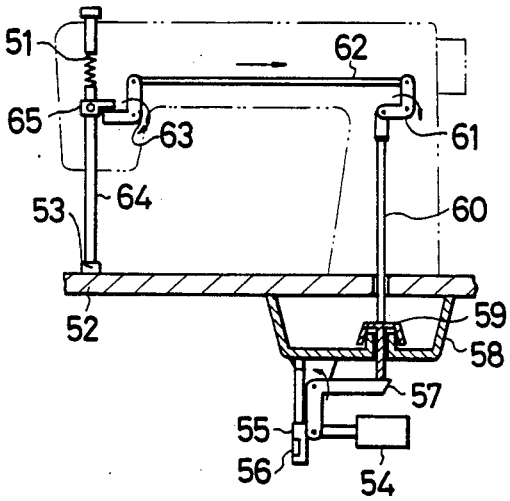
FIG. 6 PRIOR ART
FIG. 6 illustrates a presser bar lifting mechanism of a known sewing machine.

The operation of an embodiment according to the invention will now be discribed with reference to FIGS. 1-5. At first, the operation lever 2 is positioned at I as shown in FIG. 3 and FIG. 5. At this time, limit switches 4, 24 are connected to the terminal A (FIGS. 2, 3). The $\overline{R}$-$\overline{S}$ F/F 32 (flip-flop) is initiated and the terminal Q in a high level (H) condition. Thereby, the rotary solenoid 6 is in an off condition.

Under the above condition, if the knee abutment 1 is rotated counter-clockwise by an operator's knee and the knee-abutment is positioned at II (FIG. 3, FIG. 5), the limit switch 24 switches from A to B (refer to (a) in FIG. 3), and the level at terminal Q of $\overline{R}$-$\overline{S}$ F/F 30 changes from HIGH (H) to LOW (L) (refer to (c) in FIG. 3). EF 33 detects the down edge from H to L and outputs a minus pulse to the NAND-gate 41 (refer to (b) in FIG. 3). The NAND-gate 41, in which the minus pulse was inputted, outputs the plus pulse into the inverter 44, since another input terminal is at an H level. The inverter 44, into which the plus pulse was inputted, outputs a minus pulse into the terminal R of the $\overline{R}$-$\overline{S}$ F/F 32.

At this point, the level at the terminal Q of the $\overline{R}$-$\overline{S}$ F/F 32 changes from H to L. Due to this changing from H to L, the rotary solenoid 6 is excited by the solenoid drive circuit 46.

Although the rotary solenoid 6 was, by this action, excited, such type of rotary solenoid does not rotate to the maximum point suddenly, but rather rotates counter-clockwise to its maximum extent with some time delay (refer to (c), (d) in FIG. 3). When the rotary solenoid 6 is excited, the driving arm 7 rotates counter-clockwise (FIG. 1) This counter-clockwise rotation causes the stopper 10*a* to move upward via the connecting rod 8, the bell crank 9, and the spring lift arm 10. The stopper 10*a* pushes up the presser bar spring 11 against its spring force with the ring plate 12, and thus the presser bar spring is compressed (refer to (e) in FIG. 3).

Thereby, the force of the presser bar spring 11 is not applied to the presser bar 14. Rather, only the force of the auxiliary spring 13 is applied on the presser bar 14, and thus the operator can easily position the workpiece without being troubled by the design or thickness of the workpiece.

Under such condition, if the knee-abutment 1 is further rotated counter-clockwise, the lifting mechanism of the presser bar 14 is mechanically connected at position III (refer to FIG. 3, FIG. 5). As the knee-abutment 1 is rotated counter-clockwise, the presser rod 15 moves upwardly and via the second connecting rod 16, the second bell crank 17, the first connecting rod 18, the bell crank 19, and the presser bar lift arm 20, the horizontal arm 21 pushes up the transverse rod 22 against the force of the auxiliary spring 13. Thus, the presser bar 14 and the presser foot 23 are lifted (refer to (f) in FIG. 3).

At the position V in FIG. 3, FIG. 5 the presser foot reaches its highest position. During the movement of the knee-abutment 1 from IV to V, if the limit switch 4 switches from terminal A to terminal B (refer to (g) in FIG. 3) at the point IV in FIG. 3 and FIG. 5, the level of terminal Q at the R–S F/F 31 changes from H to L and EF 34, which detected the down edge, outputs a minus pulse into the NAND-gate 41 as shown at (h) in FIG. 3. Since the other input terminal of the NAND-gate 41 is H, the NAND-gate 41 outputs a plus pulse into the inverter 44, and the inverter 44 inputs a minus pulse into the terminal R of the $\overline{R}$–$\overline{S}$ F/F 32.

However, at this time the rotary solenoid 6 continues to be in an excited condition. Accordingly, by pushing the knee-abutment 1 slightly, the operation lever 2 rotates slightly, and the limit switch 4 excites the rotary solenoid 6 and resultantly the force applying on the presser foot is lessened. If the knee-abutment 1 is pushed further, the operation lever 2 rotates further, and the presser foot 23 is lifted, cooperating with the presser foot lifting mechanism.

Thus, it may be seen that in an embodiment according to the invention, there is some timing delay between the positions of the knee-abutment 1 when the rotary solenoid 6 is excited (position II is FIG. 5) and when the presser bar 14 starts to upward. Because of this timing delay, the solenoid 6 is excited earlier than the beginning of the up ward motion of the presser bar 14, and thus the timing for exciting the rotary solenoid 6 is correctly set. When the operator releases the knee-abutment 1, the knee abutment 1 rotates clockwise, and the horizontal arm 21 descends via the second connecting rod 16, the bell-crank 17, the connecting rod 18, the bell crank 19, and the presser bar lift arm 20. Simultaneously the presser foot 23 descends as the auxiliary spring 13 is pressing down the presser foot 23.

When the knee abutment 1 is positioned at IV in FIG. 5, the limit switch 4 switches from terminal A to terminal B (refer to (g) and position IV in FIG. 3) and the signal level at terminal Q of $\overline{R}$–$\overline{S}$ F/F 31 changes from L to H and the ER 37, which detected the leading edge, outputs a minus pulse into the NAND-gate 42 (refer to (j) in FIG. 3).

Since the NAND-gate 42, which received the minus pulse, has another input terminal with an H level, the NAND-gate 42 outputs a plus pulse into the inverter 45, and the inverter 45, which received the plus pulse, inputs a plus pulse to the terminal S of $\overline{R}$–$\overline{S}$ F/F 32. Then, the level of the terminal Q of $\overline{R}$–$\overline{S}$ F/F 32 changes from L to H and due to this change, the rotary solenoid 6 is unexcited by the solenoid driving circuit 46. Then, the driving arm 7 rotates clockwise and causes the stopper 10*a* to descend via the connecting rod 8, the bell crank 9 and the spring lift arm 10. Siultaneously, the presser bar spring 11 presses the ring plate 12, and the presser bar receives forces of both the presser bar spring 11 and the auxiliary spring 13.

When the knee-abutment 1 is positioned at III′ in FIG. 3 (position III in FIG. 5), the presser foot 23 contacts with the throat plate 25; this is the lowest position of the presser bar 23. At this position, the workpiece should not slip even if pulled in an opposite direction of feeding, since it is pressed firmly by both the presser bar spring 11 and the auxiliary spring 13. When the knee-abutment 1 is positioned at II′ in FIG. 3, the limit switch 24 switches from terminal B to A, but the rotary solenoid 6 is still in the off condition (refer (a), (j) in FIG. 3).

Referring to FIG. 5, when the knee-abutment moves from I-II-I, during I-II movement, at position II, the limit switch 24 switches from terminal A to terminal B and the rotary solenoid 6 is excited. At this time, the presser foot 23 is receiving the force of the auxiliary spring 13 only. If the knee abutment 1 moves clockwise, the limit switch 24 switches from terminal B to terminal A the position II, and the rotary solenoid 6 unexcites, and the presser bar spring 11 presses on the presser foot 23. When the knee-abutment 1 is positioned between II and III in FIG. 5, and the limit switch 24 is switching to terminal B, only the auxiliary spring 13 is pressing the presser foot 23.

If the pedal switch used to start sewing is pressed, a signal which changed from H to L inputs into EF 35 via terminal P (refer to FIG. 2) and the EF 35, which detected the down-edge, outputs a minus pulse to the NAND-gate 42. The NAND-gate 42, which is inputted with the minus pulse, outputs a plus pulse to the inverter 45 since its other input terminal is at an H level. The inverter, which is inputted with a plus pulse, inputs a minus pulse to the terminal S of $\overline{R}$–$\overline{S}$ F/F 32 and the terminal Q of $\overline{R}$–$\overline{S}$ F/F 32 changes from L to H, and the rotary solenoid 6 is unexcited by the solenoid driving circuit 46. Accordingly, the presser bar spring 11 presses the presser foot 23 and the sewing work starts.

On the other hand, when the pedal switch is released to stop the sewing machine, the signal from the start pedal changes from L to H. At such a condition, if the knee abutment 1 is slightly pressed and the limit switch 24 is connected to terminal B, the following procedures will occur. ER 38, which detected the leading edge, outputs a minus pulse into the inverter 39, and the inverter 39, inputted with this minus pulse, outputs a plus pulse to the terminal of the NAND-gate 40 whose other terminal is at an H level. The minus pulse outputted from the NAND-gate 40 passes through the NAND-gate 41 and is changed to a minus pulse at the inverter 44, and this minus pulse is inputted into the terminal R of $\overline{R}$–$\overline{S}$ F/F 32. Then, the terminal Q of $\overline{R}$–$\overline{S}$F/F 32 changes from L to H and the rotary solenoid 6 excites, and only the auxiliary spring 13 presses the presser foot 23.

When the pedal switch is moved to "start sewing" at position II in FIG. 5, the solenoid driving circuit is kept unexcited, and even if the knee-abutment is operated incorrectly the sewing will be conducted with proper pressure against the presser foot.

As aforementioned, the operator can clamp the workpiece by applying slight pressure against the knee-abutment. The position of the knee-abutment to excite the rotary solenoid and the position of the knee-abutment to start the lifting mechanism are spaced with some clearance to compensate for the timing delay of the solenoid excitement and thus the operator can rotate the operation lever 12 without feeling any resisting force of the presser bar spring 11. The operator can thus easily operate the machine with less fatigue than machines of the prior art.

As many apparently widely different embodiments of the invention may be made without departing from the spirit and scope therein, it is to be understood that invention is not limited to the specific embodiments herein disclosed, but rather, the invention is to be defined only in accordance with the claims which follow.

I claim:

1. A presser foot lifting mechanism, comprising:

a presser bar having a presser foot at a lower end, said pressor foot bar being sustained to move up and down relative to a machine frame;

a pair of elastic means disposed separately along the presser bar and urged to press the presser bar downwardly;

an operation lever moveable by knee-action from a predetermined position in one direction;

linkage assembly means for lifting the presser bar against said pair of elastic means in relation to displacement of the operation lever from the predetermined position;

signal detecting means for detecting signals generated by a signal generating means actuated by the displacement of said operation lever;

drive means for releasing one of said pair of elastic means; and a control circuit for energizing said drive means in relation to the generated signals; wherein the displacement of said operation lever between a first position where a release signal will be detected and a second position where one of the elastic means will have already been released by said drive means requires more elasped time than the time interval between the drive means being signaled to work and the drive means actually working.

2. A presser foot lifting mechanism, as recited in claim 1, wherein said pair of elastic means comprise a pair of springs.

3. A presser foot lifting mechanism, as recited in claim 1, wherein said drive means is a magnetic drive means.

4. A presser foot lifting mechanism, as recited in claim 3, wherein said magnetic drive means is a solenoid.

* * * * *